US005588309A

United States Patent [19]

Chioffe

[11] Patent Number: 5,588,309

[45] Date of Patent: Dec. 31, 1996

[54] EARRING BACK ADAPTER

[76] Inventor: Joseph J. Chioffe, 2710 Neaton Ct., Wellington, Fla. 33414

[21] Appl. No.: 498,137

[22] Filed: Jul. 5, 1995

[51] Int. Cl.[6] ..... A44C 7/00

[52] U.S. Cl. ..... 63/12; 24/705

[58] Field of Search ..... 63/12, 13; 24/705

[56] References Cited

U.S. PATENT DOCUMENTS

| | | | |
|---|---|---|---|
| D. 264,060 | 4/1982 | Epstein | 63/13 X |
| 1,324,466 | 12/1919 | Pirro | 24/705 |
| 4,630,452 | 12/1986 | Connelly et al. | 24/705 X |
| 4,631,929 | 12/1986 | Hollingworth | 63/13 |
| 4,688,400 | 8/1987 | Chioffe | 63/12 |
| 5,031,419 | 7/1991 | Gelman | 24/705 X |
| 5,170,643 | 12/1992 | Porcell, Jr. | 63/12 X |

FOREIGN PATENT DOCUMENTS

| | | | |
|---|---|---|---|
| 2519523 | 7/1983 | France | 63/12 |
| 2234153 | 1/1991 | United Kingdom | 63/12 |

*Primary Examiner*—Joanne Silbermann
*Attorney, Agent, or Firm*—Lilling & Lilling, P.C.

[57] ABSTRACT

The device includes a conventional ornament holder with a friction post which is connected to a conventional back clutch. Attached to the back clutch is a clutch adapter, which is designed to move along a bridge mechanism that is composed of a bent spring wire. At the other end of the spring wire, a base is provided to which a second ornament holder may be affixed.

1 Claim, 2 Drawing Sheets

FIG. 2
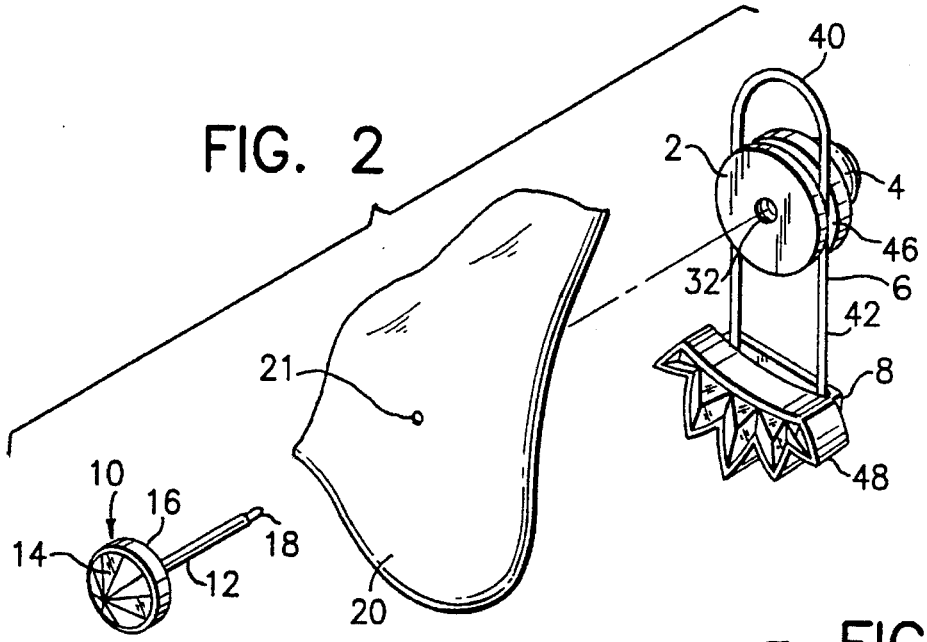
FIG. 3
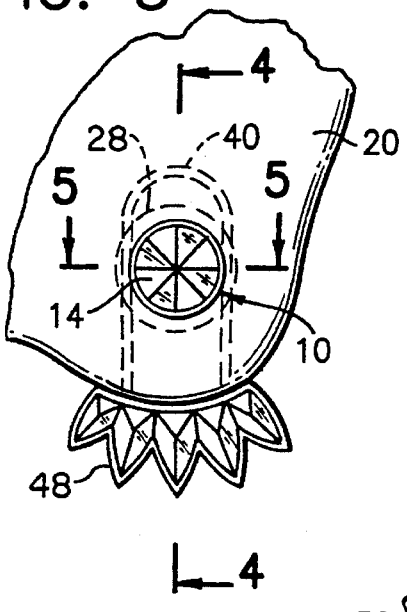
FIG. 4
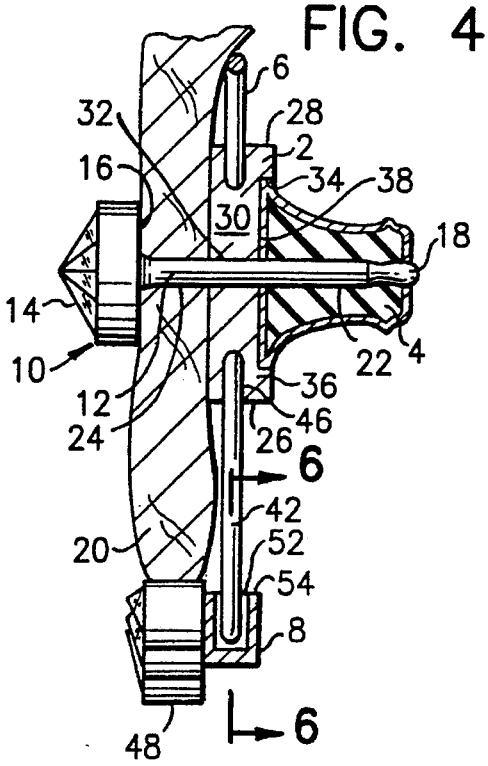
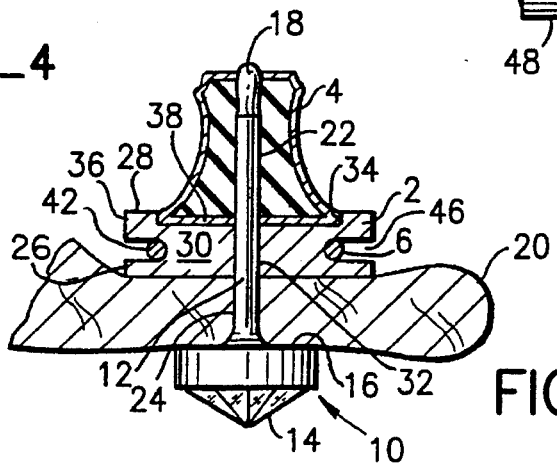
FIG. 5

EARRING BACK ADAPTER

FIELD OF THE INVENTION

The invention relates to the jewelry industry. In particular, it involves an adapter which may be used on the clutch portion of an earring in order to make it possible to hang additional decorations from the earring.

BACKGROUND OF THE INVENTION

In my earlier U.S. Pat. No. 4,688,400, an earring back is disclosed, wherein the back clutch of the earring may slide up and down a bridge in order to adjust the distance between the clutch and the ornament holder. This device had many disadvantages, however.

A first problem with the prior earring back device was that it was not designed, so that it could be used with a conventional clutch that may have been sold with a pair of earrings. As such, it was not a readily usable device, as it could not be easily adapted for earrings already in the marketplace.

Another problem with the earlier design is that the bridge mechanism did not provide any inward tension. As a result, it fit too loosely in the base and the unit was not sufficiently strong.

These and other deficiencies in the prior device have been overcome by the new earring back adaptor. In particular, it provides a unit which may be assembled with a conventional clutch that is present on earrings in the marketplace. Further, the bridge assembly is attached in a distinct manner, so as to increase the inward tension of the bridge and to thus provide greater stability for the unit.

BRIEF DESCRIPTION OF THE DRAWINGS

FIG. 2 is an exploded side perspective view of the earring back adaptor, the earring with the friction post and a person's ear.

FIG. 3 is a side view of an earring with the earring back adaptor of this invention being worn on a person's ear.

FIG. 4 is a cross sectional view taken along lines 4—4 of FIG. 3.

FIG. 5 is a cross sectional view taken along lines 5—5 of FIG. 3.

DETAILED DESCRIPTION OF THE INVENTION

Figure 1:
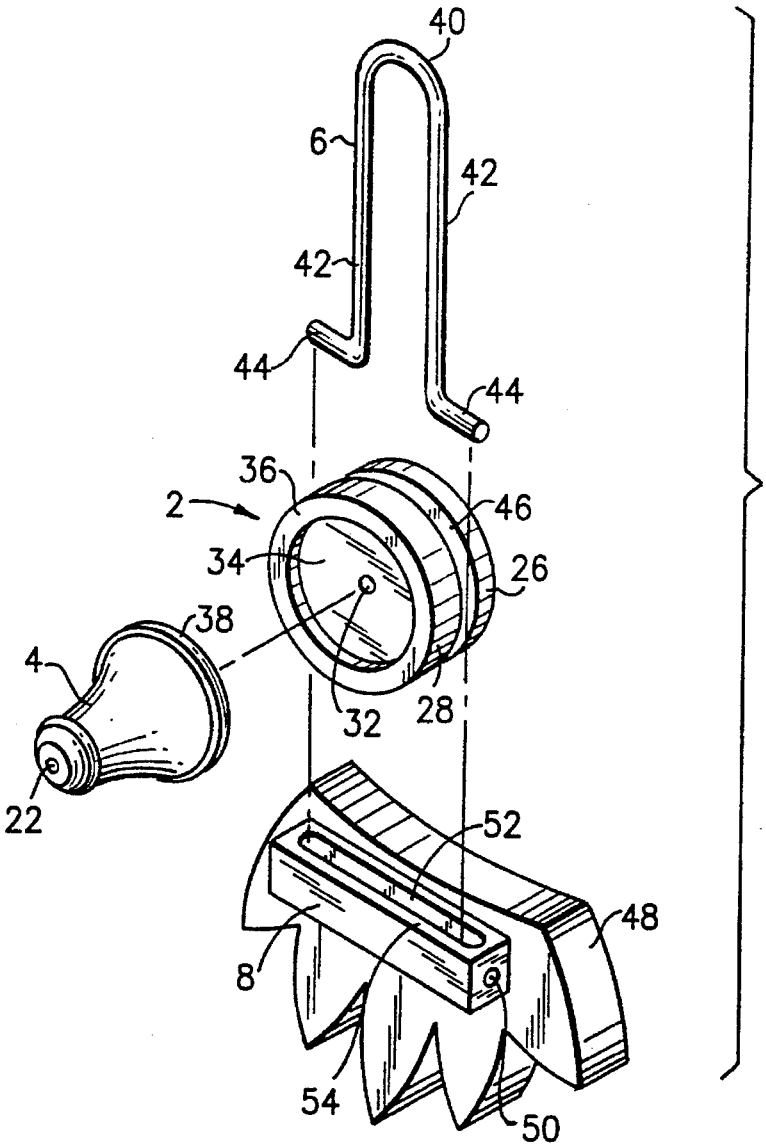
FIG. 1 is an exploded perspective view of the earring back adaptor.
Figure 6:
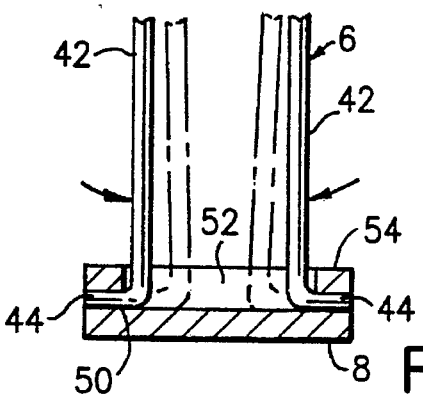
FIG. 6 is a cross sectional view taken along lines 6—6 of FIG. 4.

The invention includes an earring back adaptor 2 which is affixed to the back clutch 4 in a conventional pair of earrings. A bridge 6 is connected to the back adaptor 2, so as to permit sliding movement by the back adaptor 2 up and down along the bridge. At the other end of the bridge, an ornament holder 8 is provided.

The earring includes a front ornament holder 10 with any desired ornamentation affixed on its outer surface 14. Extending outward from its inner surface 16 is a friction post 12. The front ornament holder 10 may be made of any suitable material, such as gold, silver or other metal compounds. The friction post itself may be made out of any suitable metal, as is common in the industry.

Preferably, the distal 18 of the friction post 12 is made narrow and pointy, so as to facilitate passing through the opening in the ear lobe 20.

The back clutch 4 is of common design, as used in the industry. It has a central opening 22, which serves to frictionally hold the friction post 12 and to keep the entire earring unit together as a single assembly.

One of the novel aspects of the invention is the clutch adapter 2. The clutch adaptor is essentially round in configuration. It includes a base portion 26, which is round and flat. In the preferred embodiment, it has a diameter of 0.32 inches and is 0.030 inches thick. A top or receptacle disk 28 is also circular in configuration and has a diameter of 0.32 inches in the preferred embodiment. Its preferred thickness is 0.05 inches. A central stem portion 30 connects the base 26 and receptacle portion 28 into a single contiguous and integral unit. The stem 30 has preferably a diameter of 0.16 inches. The entire clutch adapter has a total thickness of 0.12 inches in the preferred embodiment. In its finished configuration, it is somewhat like the shape of a yo-yo, with two outer disks and an inner stem.

There is a central opening 32 which passes through the entire clutch adaptor 2. As will be hereinafter explained, it is in alignment with the central opening 22 of the back clutch 4 and permits passage of the friction post 12.

The receptacle disk portion 28 of the clutch adaptor 2 includes a central receiving area 34, defined by a shoulder 36 around the periphery of the receptacle disk 28. The central receiving area 34 is of a circular configuration and preferably has a diameter of 0.24 inches. The preferred thickness of the shoulder is 0.08 inches. The height of the shoulder portion is 0.020 inches. In such manner, there is a receiving area defined in the top of the clutch adaptor 24.

The exact size of the central receiving area 34 of the clutch adaptor 2 is made to correspond to the flat inner surface 38 of the back clutch 4. Thus, the back clutch 4 can have its inner surface 38 press fit into the central receiving area 34 of the clutch adaptor 2 to thereby obtain a unitary assembly.

The bridge 6 may be made of spring wire that is essentially in a U-shape. It has a top curve 40 with straight wire sides 42. The bottoms of the wire 42 are bent outward to form feet 44 that extend essentially perpendicular to the wires 42.

In the preferred embodiment, the wire is 0.036 inches round and may generally be made of polished stainless spring steel. In the preferred embodiment, the height of the bridge is 0.6 inches. The bridge may preferably be bent so that the distance between the inner surfaces of the wires 42 is 0.15 inches and the distance between the outer surfaces of the wires is 0.222 inches. The length of the feet may preferably be 0.1 inch and the distance from the outer edge of one foot to the outer edge of the other foot should preferably be 0.35 inches.

As is apparent from the structure of the clutch adaptor, a slot 46 is defined by the central stem and the disks 26 and 28. The bridge is positioned, so that the clutch adaptor 2 may slide up and down along the wires.

The base may have any conventional ornament holder 48 attached to it by any suitable means, such as soldering or adhesives. The base 8 may be of substantially rectangular configuration with a through hole 50 along its longitudinal axis with a central slot 52 in its top surface 54.

To assemble the unit, the wires 42 are pressed together in order to move the feet 44 close together. The feet can then be positioned in the slot 52 of the base 48. As the wires are released, the wires spread and the feet 44 become captured within the central hole or opening 50 of the base 48. In this manner, the requisite tension is maintained and the unit can be held together securely. By such means, the base 48 provides a greater function than the base in my earlier U.S. Pat. No. 4,688,400. In particular, the base with the slot 52 enables the base to more securely hold the wires with a greater level of tension. The slot controls the spreading of the wires and helps to maintain the requisite tension that is required.

In this manner, a conventional clutch of an earring can be readily affixed to a bridge in order to support and hold additional ornaments.

The invention is described in detail with reference to a particular embodiment, but it should be understood that various other modifications can be effected and still be within the spirit and scope of the invention.

I claim:

1. An earring back adapter comprising:

a first ornament holder having a friction post;

a back clutch with a central opening to accomodate and hold said friction post of said first ornament holder;

a back clutch adapter having a central opening through which said friction post of said first ornament holder may pass, said back clutch adapter having a base portion, a top disk and a central stem that define a channel, and said top disk of said back clutch adapter having a depressed receiving area for frictional engagement and securement of said back clutch;

a bridge consisting of a bent spring wire having a U-shape and long ends of said bent spring wire passing through said channel defined in said back clutch adapter, and said back clutch adapter being moveable along said spring wire of said bridge mechanism, bottom ends of said bent spring wire being bent outward to define feet; and, a second ornament holder connected to said ends of said bent spring wire of said bridge mechanism, wherein said feet at the bottoms of said bent spring wire are held under tension within openings in said second ornament holder.

* * * * *